US009186008B2

(12) United States Patent
MacLaren

(10) Patent No.: US 9,186,008 B2
(45) Date of Patent: Nov. 17, 2015

(54) CLOTHES HANGER

(71) Applicant: Ellie K. MacLaren, Naples, FL (US)

(72) Inventor: Ellie K. MacLaren, Naples, FL (US)

( * ) Notice: Subject to any disclaimer, the term of this patent is extended or adjusted under 35 U.S.C. 154(b) by 48 days.

(21) Appl. No.: 14/076,348

(22) Filed: Nov. 11, 2013

(65) Prior Publication Data

US 2015/0129622 A1 May 14, 2015

(51) Int. Cl.
*A47G 25/14* (2006.01)
*A47G 25/74* (2006.01)

(52) U.S. Cl.
CPC ..... *A47G 25/14* (2013.01); *A47G 25/743* (2013.01)

(58) Field of Classification Search
CPC ... A47G 25/14; A47G 25/1414; A47G 25/74; A47G 25/743
USPC ..... D6/315, 318
See application file for complete search history.

(56) References Cited

U.S. PATENT DOCUMENTS 3,310,179 A * 3/1967 Cappuzzello ..... 211/113
3,452,881 A * 7/1969 Jamison ..... 211/119
3,746,223 A * 7/1973 Batts ..... 223/91
4,248,363 A 2/1981 Zuckerman et al.
5,421,465 A * 6/1995 Dunner, Jr. ..... 211/115
5,642,841 A * 7/1997 Beaty ..... 223/85
5,881,931 A * 3/1999 Stanfield ..... 223/85
D411,373 S * 6/1999 McKinney ..... D6/315
5,950,884 A * 9/1999 Payne ..... 223/85
6,053,378 A * 4/2000 Doyel ..... 223/86
6,070,773 A 6/2000 Pogoda
6,296,160 B1 * 10/2001 Murray ..... 223/88
7,118,014 B2 10/2006 Ali et al.
D541,056 S * 4/2007 Magwood ..... D6/315
7,624,900 B2 12/2009 McLaughlin
7,628,302 B2 12/2009 Yau
8,070,025 B1 * 12/2011 Nelson ..... 223/88
2004/0020948 A1 * 2/2004 Harris ..... 223/85
2004/0079771 A1 * 4/2004 Salcedo ..... 223/85
2004/0159686 A1 8/2004 Huang
2007/0045360 A1 * 3/2007 Grimes ..... 223/85
2008/0308511 A1 * 12/2008 Ruelas ..... 211/85.3
2009/0057166 A1 * 3/2009 Nelson ..... 206/6.1
2012/0228342 A1 * 9/2012 Lewis ..... 223/88

FOREIGN PATENT DOCUMENTS

EP 0910976 4/1999

* cited by examiner

*Primary Examiner* — Shaun R Hurley
*Assistant Examiner* — Andrew W Sutton
(74) *Attorney, Agent, or Firm* — Livingston Loeffler, P.A.; Edward M. Livingston, Esq.; Bryan L. Loeffler, Esq.

(57) ABSTRACT

A clothes hanger (1) having a plurality of hooks (8) located thereon for hanging tank tops or other strapped articles of clothing. The clothes hanger allows a user to hang multiple articles of clothing on the plurality of hooks, thereby conserving storage space in a closet. The positioning of the hooks allows the clothes hanger to remain level by being counterbalanced while hanging in a closet.

7 Claims, 2 Drawing Sheets

CLOTHES HANGER

FIELD OF THE INVENTION

This invention relates to clothes hangers, and more particularly, to a clothes hanger used for hanging one or more articles of clothing with straps, such as tank tops, camisoles, bras, dresses and so forth.

BACKGROUND OF THE INVENTION

A clothes hanger is a device in the shape of human shoulders designed to facilitate the hanging of articles of clothing such as shirts, tops, jackets and so forth. Conventional hangers consist of wire hangers bent in a flattened triangle-like shape that continues into a hook at the top, wooden hangers cut into a boomerang-like shape or triangle-like shape having a hook protruding from the top, and plastic hangers molded into boomerang-like shape or triangle-like shapes with a hook located on top.

Many hangers have notches or loops located thereon to hang an article of clothing having shoulder straps. Each strap is secured to a single notch or single loop located on opposite sides of the hanger. The article of clothing then spans the length of the hanger and the notches or loops keep the article of clothing from sliding off ends of the hanger. However, a problem with such conventional hangers is that only one article of clothing may be hung on a single hanger. This means multiple articles of clothing are hung sided by side (each on separate hangers) on a closet hanging rod, thereby taking up extra space in a closet.

Therefore, a need exists for a clothes hanger that will allow a user to hang multiple articles of clothing thereon to conserve storage space while still making it easy to organize the articles of clothing for easy access to the clothing.

The relevant prior art includes the following references:

| Pat. No. | Inventor | Issue/Publication Date |
|---|---|---|
| | (U.S. Pat. References) | |
| 4,248,363 | Zuckerman et al. | Feb. 3, 1981 |
| 5,881,931 | Stanfield | Mar. 16, 1999 |
| 6,070,773 | Pogoda | Jun. 6, 2000 |
| 2004/0159686 | Huang | Aug. 19, 2004 |
| 7,118,014 | Ali et al. | Oct. 10, 2006 |
| 7,624,900 | McLaughlin | Dec. 1, 2009 |
| 7,628,302 | Yau | Dec. 8, 2009 |
| | (Foreign Pat. References) | |
| EP0910976 | Willputz | Apr. 28, 1999 |

Non-Patent Literature hankytankyhanger.com printout
loopers.squarespace.com printout
hiyaheidi.blogsspot.com printout

SUMMARY OF THE INVENTION

The primary object of the present invention is to provide a clothes hanger that will allow a user to hang multiple articles of clothing thereon to conserve storage space while still making it easy to organize the articles of clothing for easy access to the clothing.

The present invention fulfills the above and other objects by providing a hanger having a plurality of hooks located thereon for hanging multiple tank tops or other strapped articles of clothing. A plurality of hanging hooks extends from opposite sides of the hanger along the length of each side of the hanger. When multiple articles of clothing are placed on each side of the hanger, a counter balance is created so when multiple tank tops or other strapped articles of clothing are stored on the hanger, the hanger remains level. By hanging multiple articles of clothing on the single hanger, horizontal storage pace in a closet is saved. The hooks may be retractable into the body of the hanger and/or hingedly attached to the body of the hanger. In addition, the clothes hanger of the present invention may be used to store and organize jewelry.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
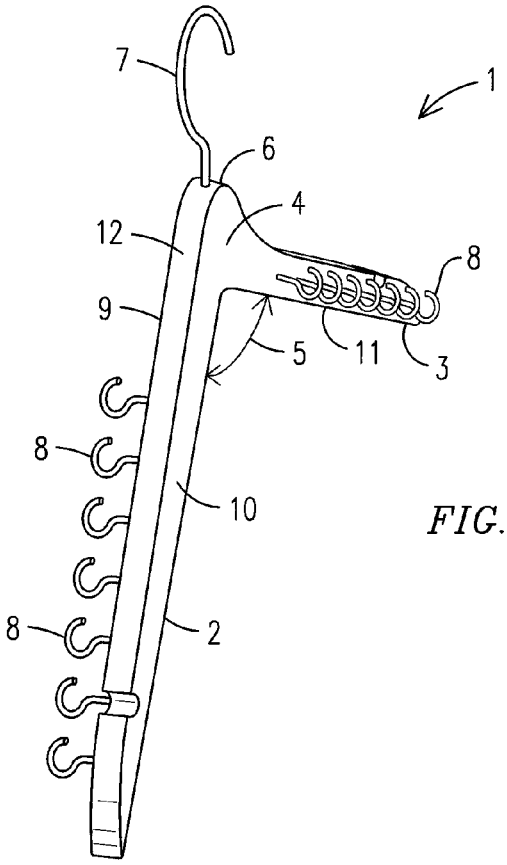
FIG. 1 is a perspective side view of a clothes hanger of the present invention.
Figure 2:
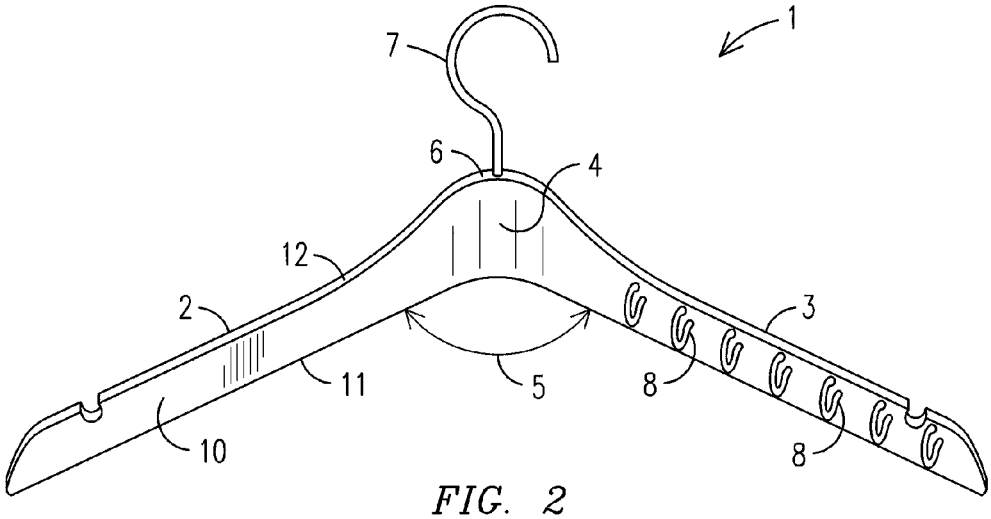
FIG. 2 is a front view of a clothes hanger of the present invention.
Figure 3:
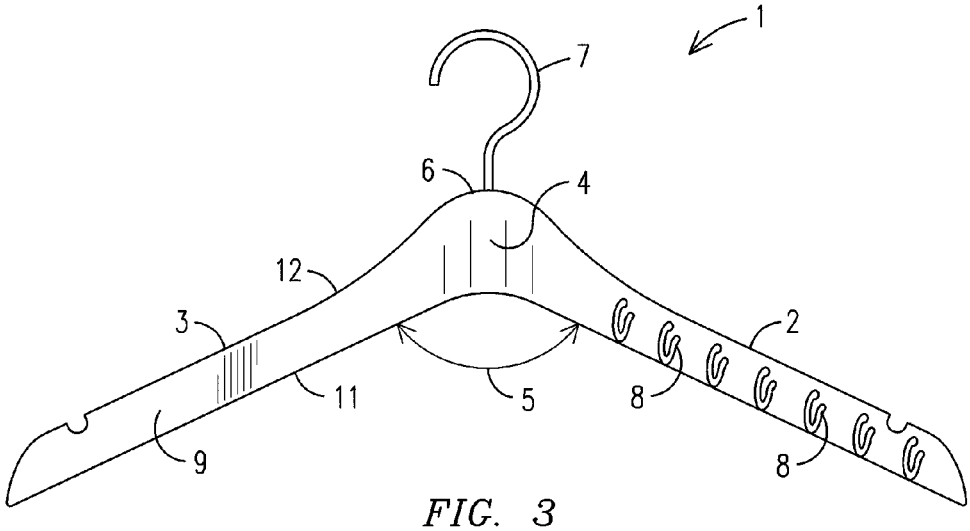
FIG. 3 is a rear view of a clothes hanger of the present invention.
Figure 4:
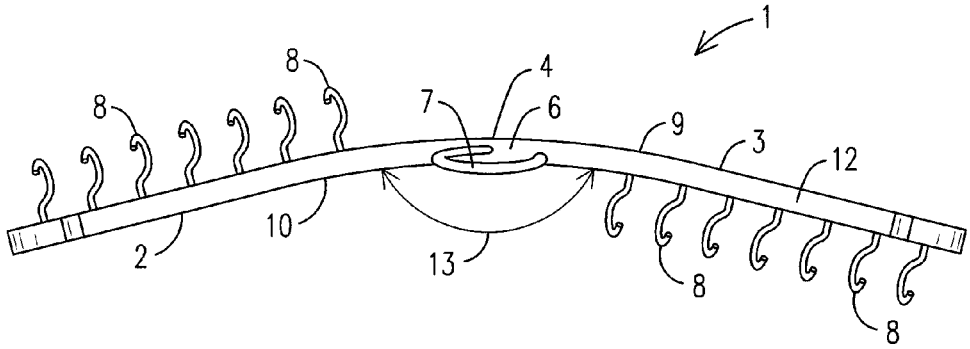
FIG. 4 is a top view of a clothes hanger of the present invention.

For purposes of describing the preferred embodiment, the terminology used in reference to the numbered components in the drawings is as follows:

1. clothes hanger, generally
2. first side of clothes hanger
3. second side of clothes hanger
4. center of clothes hanger
5. horizontal angle
6. apex
7. rod hanging hook
8. strap hanging hook
9. rear surface of clothes hanger
10. front surface of clothes hanger
11. bottom surface of clothes hanger
12. top surface of clothes hanger
13. vertical angle With reference to FIGS. 1-4, a perspective side view, a front view, a rear view and a top view, respectively, of a clothes hanger 1 of the present invention are illustrated. The clothes hanger 1 comprises a first side 2 and a second side 3 meeting at a center 4 of the clothes hanger 1 and extending away from each other a predetermined distance. The first side 2 and second side 3 may be parallel to each other or the first side 2 and second side 3 of the clothes hanger 1 may angle downward from the center 4 to create a horizontal angle 5 and a substantially boomerang-like shape having an apex 6. A rod hanging hook 7 extends upward from the center 4 of the clothes hanger 1. The rod hanging hook 7 is used to hang the clothes hanger 1 in a closet from a hanging rod. At least two strap hanging hooks 8 are located on the first side 2 and at least two strap hanging hooks 8 are located on the second side 3. Each strap hanging hook 8 located on the first side 2 is preferably located to mirror the location of each strap hanging hook 8 located on the second side 3. For example, each strap hanging hook 8 is an equal distance from the center 4 of the clothes hanger 1 as compared to the countering strap hanging hook 8 located on the opposite side of the clothes hanger 1. The placement or location of the strap hanging hooks 8 allows for the clothes hanger 1 to be counterbalanced so the clothes hanger 1 remains in a level position while hanging in a closet. The strap hanging hooks 8 located on the first side 2 may also be located on a surface that is opposite to a surface the strap hanging hooks 8 located on the second side 3 are located on. As illustrated here, the strap hanging hooks 8 located on the first side 2 are located on a rear surface 9 of the clothes hanger 1 and the strap hanging hooks 8 located on the second side 3 are located on a front surface 10 of the clothes hanger 1. This further allows for the clothes hanger 1 to be counterbalanced so the clothes hanger 1 remains in a level position while hanging in a closet. However, although the strap hanging hooks 8 are illustrated as being located on the front surface 10 and the rear surface 9 of the clothes hanger 1, the strap hanging hooks 8 may also be located on a bottom surface 11 of the clothes hanger 1, a top surface 12 of the clothes hanger 1 and/or be notches located on a top surface 12 of the clothes hanger 1.

In addition, the first side 2 and second side 3 may angle outward from each other in the same or opposite directions to create a vertical angle 13 at the center 4 of the clothes hanger 1. This vertical angle 13 provides for a further counter balance to the clothes hanger 1.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A clothes hanger for hanging strapped articles of clothing comprising:

a first side and a second side each extending a predetermined distance away from each other at a center of the clothes hanger;

a rod hanging hook extending upward from the center of the clothes hanger;

a plurality of strap hanging hooks located on a front surface of the first side of the clothes hanger;

a rear surface of the first side of the clothes hanger being a substantially planar surface with no strap hanging hooks located thereon;

a plurality of strap hanging hooks located on a rear surface of the second side of the clothes hanger;

a front surface of the second side of the clothes hanger being a substantially planar surface with no strap hanging hooks located thereon;

said number of strap hanging hooks located on the first side of the clothes hanger is equal to said number of strap hanging hooks located on the second side of the clothes hanger; and the plurality of strap hanging hooks located on the first side mirror the location the plurality of strap hanging hooks located on the second side in regards to the distance each strap hanging hook is located from the center of the clothes hanger.

2. The clothes hanger of claim 1 wherein:

said plurality of strap hanging hooks located on the first side are each substantially C-shaped hooks; and said plurality of strap hanging hooks located on the second side are each substantially C-shaped hooks.

3. The clothes hanger of claim 1 wherein:

said first side of the clothes hanger angles downward from the second side of the clothes hanger, thereby creating horizontal angle and a substantially boomerang shape having an apex located on a top surface of the clothes hanger.

4. The clothes hanger of claim 1 wherein:

said first side and second side angle outward from each other to create a vertical angle at the center of the clothes hanger.

5. A clothes hanger for hanging strapped articles of clothing comprising:

a first side and a second side each extending a predetermined distance away from each other at a center of the clothes hanger;

a rod hanging hook extending upward from the center of the clothes hanger;

a plurality of strap hanging hooks located on a rear surface of the first side of the clothes hanger;

a front surface of the first side of the clothes hanger being a substantially planar surface with no strap hanging hooks located thereon;

a plurality of strap hanging hooks located on a front surface of the second side of the clothes hanger;

a rear surface of the second side of the clothes hanger being a substantially planar surface with no strap hanging hooks located thereon;

said number of strap hanging hooks located on the first side of the clothes hanger is equal to said number of strap hanging hooks located on the second side of the clothes hanger; and the plurality of strap hanging hooks located on the first side mirror the location the plurality of strap hanging hooks located on the second side in regards to the distance each strap hanging hook is located from the center of the clothes hanger.

6. The clothes hanger of claim 5 wherein:

said first side of the clothes hanger angles downward from the second side of the clothes hanger, thereby creating horizontal angle and a substantially boomerang shape having an apex located on a top surface of the clothes hanger.

7. The clothes hanger of claim 5 wherein:

said first side and second side angle outward from the center of the clothes hanger to create a vertical angle at the center of the clothes hanger.

* * * * *